US005857694A

United States Patent [19]

Lazarus et al.

[11] Patent Number: 5,857,694

[45] Date of Patent: Jan. 12, 1999

[54] ADAPTIVE SPORTS IMPLEMENT

[75] Inventors: Kenneth B. Lazarus, Boston; Jeffrey W. Moore, Arlington; Robert N. Jacques, Hopkington; Jonathan C. Allen, Brookline, all of Mass.

[73] Assignee: Active Control Experts, Inc., Cambridge, Mass.

[21] Appl. No.: 536,067

[22] Filed: Sep. 29, 1995

[51] Int. Cl.[6] ..... A63C 5/075

[52] U.S. Cl. ..... 280/602; 280/601; 310/317; 310/326; 473/282; 473/318; 473/521

[58] Field of Search ..... 280/602, 601, 280/610, 609; 310/316, 317, 326, 327, 328; 473/282, 289, 318, 316, 521, 520

[56] References Cited

U.S. PATENT DOCUMENTS

| | | | |
|---|---|---|---|
| 4,565,940 | 1/1986 | Hubbard, Jr. | 310/326 |
| 4,849,668 | 7/1989 | Crawley et al. | 310/328 |
| 5,315,203 | 5/1994 | Bicos | 310/326 |
| 5,390,949 | 2/1995 | Naganathan | 280/707 |
| 5,499,836 | 3/1996 | Juhasz | 280/602 |
| 5,590,908 | 1/1997 | Carr | 280/601 |
| 5,615,905 | 4/1997 | Stepanek et al. | 280/602 |
| 5,645,260 | 7/1997 | Falangas | 248/550 |

FOREIGN PATENT DOCUMENTS

| | | | |
|---|---|---|---|
| 0162372 | 11/1985 | European Pat. Off. | 280/602 |
| 2643430 | 8/1990 | France | 280/602 |
| 2502031 | 7/1976 | Germany | 280/602 |
| 0465603 | 7/1991 | Sweden . | |

*Primary Examiner*—Anne Marie Boehler
*Attorney, Agent, or Firm*—Lahive & Cockfield, LLP

[57] ABSTRACT

A sports implement including an electroactive element, such as a piezoceramic sheet attached to the implement and a circuit attached to the electroactive element. The circuit may be a shunt, or may include processing such as amplification and phase control to apply a driving signal which may compensate for strain sensed in the implement, or may simply alter the stiffness to affect performance. In a ski, the electroactive element is located near to the root in a region of high strain to apply damping, and the element captures between about one and five percent of the strain energy of the ski. The region of high strain may be found by modeling mechanics of the sports implement, or may be located by empirically mapping the strain distribution which occurs during use of the implement. In other embodiments, the electroactive elements may remove resonances, adapt performance to different situations, or enhance handling or comfort of the implement. Other embodiments include striking implements intended to hit a ball or object in play, such as golf clubs and tennis racquets, wherein the strain elements may alter the performance, feel or comfort of the implement.

31 Claims, 12 Drawing Sheets

ADAPTIVE SPORTS IMPLEMENT

BACKGROUND OF THE INVENTION

The present invention relates to sports equipment, and more particularly to damping, controlling vibrations and affecting stiffness of sports equipment, such as a racquet, ski, or the like. In general, a great many sports employ implements which are subject to either isolated extremely strong impacts, or to large but dynamically varying forces exerted over longer intervals of time or over a large portion of their body. Thus, for example, implements such as baseball bats, playing racquets, sticks and mallets are each subject very high intensity impact applied to a fixed or variable point of their playing surface and propagating along an elongated handle that is held by the player. With such implements, while the speed, performance or handling of the striking implement itself maybe relatively unaffected by the impact, the resultant vibration may strongly jar the person holding it. Other sporting equipment, such as sleds, bicycles or skis, may be subjected to extreme impact as well as to diffuse stresses applied over a protracted area and a continuous period of time, and may evolve complex mechanical responses thereto. These responses may excite vibrations or may alter the shape of runners, frame, or chassis structures, or other air- or ground-contacting surfaces. In this case, the vibrations or deformations have a direct impact both on the degree of control which the driver or skier may exert over his path of movement, and on the net speed or efficiency of motion achievable therewith.

Taking by way of example the instance of downhill or slalom skis, basic mechanical considerations have long dictated that this equipment be formed of flexible yet highly stiff material having a slight curvature in the longitudinal and preferably also in the traverse directions. Such long, stiff plate-like members are inherently subject to a high degree of ringing and structural vibration, whether they be constructed of metal, wood, fibers, epoxy or some composite or combination thereof. In general, the location of the skier's weight centrally over the middle of the ski provides a generally fixed region of contact with the ground so that very slight changes in the skier's posture and weight-bearing attitude are effective to bring the various edges and running surfaces of the ski into optimal skiing positions with respect to the underlying terrain. This allows control of steering and travel speed, provided that the underlying snow or ice has sufficient amount of yield and the travel velocity remains sufficiently low. However, the extent of flutter and vibration arising at higher speeds and on irregular, bumpy, icy surfaces can seriously degrade performance. In particular, mechanical vibration leads to an increase in the apparent frictional forces or net drag exerted against the ski by the underlying surface, or may even lead to a loss of control when blade-like edges are displaced so much that they fail to contact the ground. This problem particularly arises with modem skis, and analogous problems arise with tennis racquets and the like made with metals and synthetic materials that may exhibit much higher stiffness and elasticity than wood.

In general, to applicant's knowledge, the only practical approach so far developed for preventing vibration from arising has been to incorporate in a sports article such as a ski, an inelastic material which adds damping to the overall structure or to provide a flexible block device external to the main body thereof. Because of the trade-offs in weight, strength, stiffness and flexibility that are inherent in the approach of adding inelastic elements onto a ski, it is highly desirable to develop other, and improved, methods and structures for vibration control. In particular, it would be desirable to develop a vibration control of light weight, or one that also contributes to structural strength and stiffness so it imposes little or no weight penalty. Other features which would be beneficial include a vibration control structure having broad bandwidth, small volume, ruggedness, and adaptability.

The limitations of the vibrational response of sports implements and equipment other than skis or sleds are somewhat analogous, and their interactions with the environment or effect on the player may be understood, *mutatis mutandi*. It would be desirable to provide a general solution to the vibrational problem of a sports article. Accordingly, there is a great need for a sports damper.

It should be noted that in the field of advanced structural mechanics, there has been a fair amount of research and experimentation on the possibility of controlling thin structural members, such as airfoils, trusses of certain shapes, and thin skins made of advanced composite or metal material, by actuation of piezoelectric sheets embedded in or attached to these structures. However, such studies are generally undertaken with a view toward modeling an effect achievable with the piezo actuators when they are attached to simplified models of mechanical structures and to specialized driving and monitoring equipment in a laboratory.

In such cases, it is generally necessary to assure that the percentage of strain energy partitioned into the piezo elements from the structural model is relatively great; also in these circumstances, large actuation signals may be necessary to drive the piezo elements sufficiently to achieve the desired control. Furthermore, since the most effective active strain elements are generally available as brittle, ceramic sheet material, much of this research has required that the actuators be specially assembled and bonded into the test structures, and be protected against extreme impacts or deformations. Other, less brittle forms of piezo-actuated material are available in the form of polymeric sheet material, such as PVDF. However, this latter material, while not brittle or prone to cracking is capable of producing only relatively low mechanical actuation forces. Thus, while PVDF is easily applied to surfaces and may be quite useful for strain sensors, its potential for active control of a physical structure is limited. Furthermore, even for piezoceramic actuator materials, the net amount of useful strain is limited by the form of attachment, and displacement introduced in the actuator material is small.

All of the foregoing considerations would seem to preclude any effective application of piezo elements to enhance the performance of a sports implement.

Nonetheless, a number of sports implements remain subject to performance problems as they undergo displacement or vibration, and are strained during normal use. While modern materials have achieved lightness, stiffness and strength, these very properties may exacerbate vibrational problems. It would therefore be desirable to provide a general construction which reduces or compensates for undesirable performance states, or prevents their occurrence in actual use of a sports implement.

SUMMARY OF THE INVENTION

These and other desirable results are achieved in a sports damper in accordance with the present invention wherein all or a portion of the body of a piece of sporting equipment has mounted thereto an electroactive assembly which couples strain across a surface of the body of the sporting implement and alters the damping or stiffness of the body in response to strain occurring in the implement in the area where the assembly is attached. Electromechanical actuation of the assembly adds or dissipates energy, effectively damping vibration as it arises, or alters the stiffness to change the dynamic response of the equipment. The sporting implement is characterized as having a body with a root and one or more principal structural modes having nodes and regions of strain. The electroactive assembly is generally positioned near the root, to enhance or maximize its mechanical actuation efficiency. The assembly may be a passive component, converting strain energy to electrical energy and shunting the electrical energy, thus dissipating energy in the body of the sports implement. In an active embodiment, the system includes an electroactive assembly with piezoelectric sheet material and a separate power source such as a replaceable battery. The battery is connected to a driver to selectively vary the mechanics of the assembly. In a preferred embodiment, a sensing member in proximity to the piezoelectric sheet material responds to dynamic conditions of strain occurring in the sports implement and provides output signals for which are amplified by the power source for actuation of the first piezo sheets. The sensing member is positioned sufficiently close that nodes of lower order mechanical modes do not occur between the sensing member and control sheet. In a further embodiment, a controller may include logic or circuitry to apply two or more different control rules for actuation of the sheet in response to the sensed signals, effecting different actuations of the first piezo sheet.

One embodiment is a ski in which the electroactive assembly is surface bonded to or embedded within the body of the ski at a position a short distance ahead of the effective root location, the boot mounting. In a passive embodiment, the charge across the piezo elements in the assembly is shunted to dissipate the energy of strain coupled into the assembly. In another embodiment, a longitudinally-displaced but effectively collocated sensor detects strain in the ski, and creates an output signal which is used as input or control signal to actuate the first piezo sheet. A single 9-volt battery powers an amplifier for the output signal, and this arrangement applies sufficient power for up to a day or more to operate the electroactive assembly as an active damping or stiffening control mechanism, shifting or dampening resonances of the ski and enhancing the degree of ground contact and the magnitude of attainable speeds. In other sports implements the piezoelectric element may attach to the handle or head of a racquet or striking implement to enhance handling characteristics, feel and performance.

BRIEF DESCRIPTION OF THE DRAWINGS

These and other features of the invention will be understood from the description contained herein taken together with the illustrative drawings, wherein.

DETAILED DESCRIPTION

Figure 1:
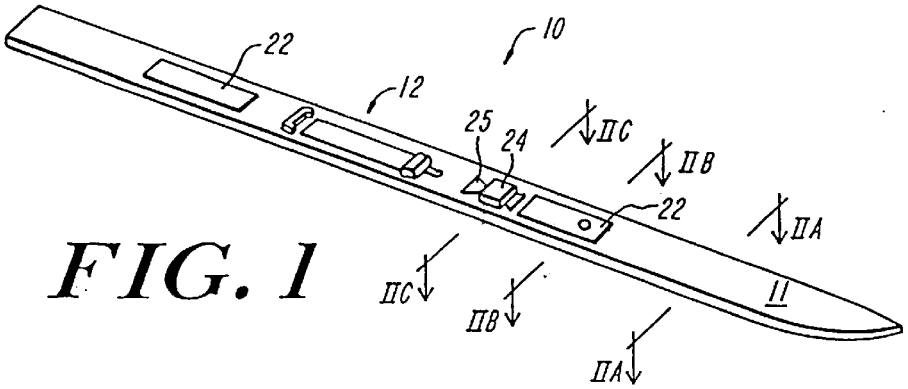
FIG. 1 shows a ski in accordance with the present invention.

FIG. 1 shows by way of example, as an illustrative sports implement, a ski 10 embodying the present invention. Ski 10 has a generally elongated body 11, and mounting portion 12 centrally located along its length, which, for example, in a downhill ski includes one or more ski-boot support plates affixed to its surface, and heel and toe safety release mechanisms (not shown) fastened to the ski behind and ahead of the boot mounting plates, respectively. These latter elements are all conventional, and are not illustrated. It will be appreciated, however, that these features define a plate-mechanical system wherein the weight of a skier is centrally clamped on the ski, and makes this central portion a fixed point (inertially, and sometimes to ground) of the structure, so that the mounting region generally is, mechanically speaking, a root of a plate which extends outwardly therefrom along an axis in both directions. As further illustrated in FIG. 1, ski 10 of the present invention has an electroactive assembly 22 integrated with the ski or affixed thereto, and in some embodiments, a sensing sheet element 25 communicating with the electroactive sheet element. and a power controller 24 in electrical communication with both the sensing and the electroactive sheet elements.

In accordance with applicant's invention, the electroactive assembly and sheet element within are strain-coupled either within or to the surface of ski, so that it is an integral part of and provides stiffness to the ski body, and responds to strain therein by changing its state to apply or to dissipate strain energy, thus controlling vibrational modes of the ski and its response. The electroactive sheet elements 22 are preferably formed of piezoceramic material, having a relatively high stiffness and high strain actuation efficiency. However, it will be understood that the total energy which can be coupled through such an actuator, as well as the power available for supplying such energy, is relatively limited both by the dimensions of the mechanical structure and available space or weight loading, and other factors. Accordingly, the exact location and positioning as well as the dimensioning and selection of suitable material is a matter of some technical importance both for a ski and for any other sports implement, and this will be better understood from the discussion below of specific factors to consider in implementing this sports damper in a ski.

By way of general background, a great number of investigations have been performed regarding the incorporation of thin piezoceramic sheets into stiff structures built up, for example, of polymer material. In particular, in the field of aerodynamics, studies have shown the feasibility of incorporating layers of electroactive material within a thin skin or shell structure to control the physical aspect or vibrational states of the structure. U.S. Pat. Nos. 4,849,648 and 5,374,011 of one or more of the present inventors describe methods of working with such materials, and refer to other publications detailing theoretical and actual results obtained this field.

More recently, applicants have set out to develop and have introduced as a commercial product packaged electroactive assemblies, in which the electroactive material, consisting of one or more thin brittle piezoceramic sheets, is incorporated into a card which may in turn be assembled in or onto other structures to efficiently apply substantially all of the strain energy available in the actuating element. Applicant's prior U.S. patent application Ser. No. 08/188,145 filed on Jan. 27, 1994, and applicant's corresponding PCT publication WO 95/20827 describes the fabrication of a thin stiff card with sheet members in which substantially the entire area is occupied by one or more piezoceramic sheets, and which encapsulates the sheets in a manner to provide a tough supporting structure for the delicate member yet allow its in-plane energy to be efficiently coupled across its major faces. That patent application and the aforementioned U.S. Patents are hereby incorporated herein by reference for purposes of describing such materials, the construction of such assemblies, and their attachment to or incorporation into physical objects. Accordingly, it will be understood in the discussion below that the electroactive sheet elements described herein are preferably substantially similar or identical to those described in the aforesaid patent application, or are elements which are embedded in, or supported by sheet material as described therein such that their coupling to the skis provides a non-lossy and highly effective transfer of strain energy therebetween across a broad area actuator surface.

Figure 1A:
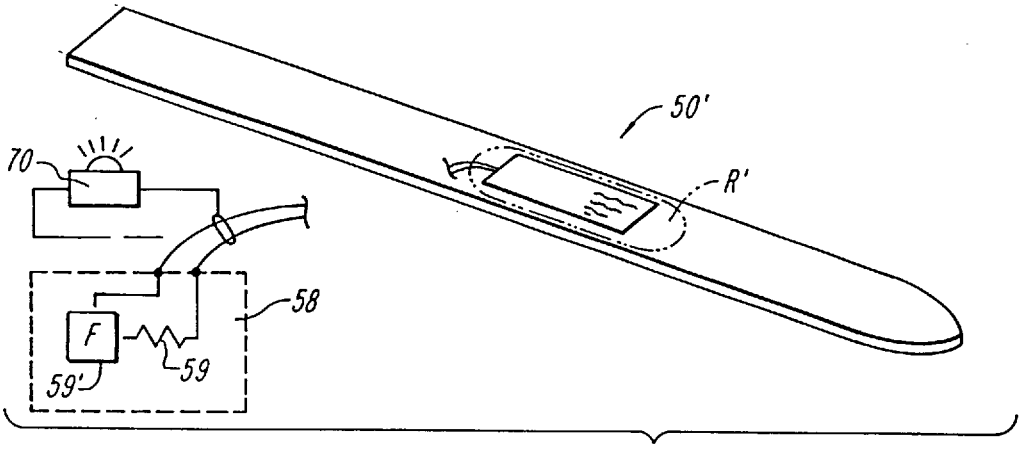
FIGS. 1A and 1C show details of a passive damper embodiment of the ski of FIG. 1.

FIG. 1A illustrates a basic embodiment of a sports implement 50' in accordance with applicant's invention embodied in the runner of a luge, or in a ski. Here a single sensor/actuator sheet element 56 covers a root region R' of the ski and its strain-induced electrical output is connected across a shunt loop 58. Shunt loop 58 contains a resistor 59 and filter 59' connected across the top and bottom electrodes of the actuator 56, so that as strain in the region R creates charge in the actuator element 56, the charge is dissipated. The mechanical effect of this construction is that strain changes occurring in region R' within the band of filter 59' are continuously dissipated, resulting, effectively, in damping of the modes of the structure. The element 56 may cover five to ten percent of the surface, and capture up to about five percent of the strain in the ski. Since most vibrational states actually take a substantial time period to build up, this low level of continuous mechanical compensation is effective to control serious mechanical effects of vibration, and to alter the response of the ski.

In practice, the intrinsic capacitance of the piezoelectric actuators operates to effectively filter the signals generated thereby or applied thereacross, so a separate filter element 59' need not be provided. In a prototype embodiment, three lead zirconium titanate (PZT) ceramic sheets PZ were mounted as shown in FIG. 1C laminated to flex circuit material in which corresponding trellis-shaped conductive leads C spanned both the upper and lower electroded surfaces of the PZT plates. Each sheet was 1.81 by 1.31 by 0.058 inches, forming a modular card-like assembly approximately 1.66×6.62 inches and 0.066 inches thick. The upper and lower electrode lines C extend to a shunt region S at the front of the modular package, in which they are interconnected via a pair of shunt resistors so that the charge generated across the PZT elements due to strain in the ski is dissipated. The resistors are surface-mount chip resistors, and one or more surface-mount LED's are connected across the leads to flash as the wafers experience strain and shunt the energy thereof. This provides visible confirmation that the circuit lines remain connected. The entire packaged assembly was mounted on the top structural surface layer of a ski to passively couple strain out of the ski body and continuously dissipate that strain. Another prototype embodiment employs four such PZT sheets arranged in a line.

Figure 1B:
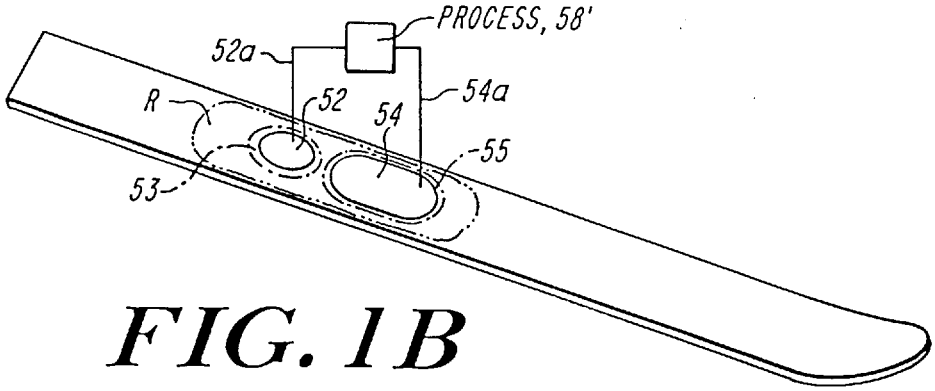
FIG. 1B shows an active embodiment thereof.

FIG. 1B illustrates another general architecture of a sports implement 50 in accordance with applicant's invention. In this embodiment a first strain element 52 is attached to the implement to sense strain and produce a charge output on line 52*a* indicative of that strain in a region 53 covering all or a portion of a region R, and an actuator strain element 54 is positioned in the region R to receive drive signals on line 54*a* and couple strain into the sports implement over a region 55. Line 52*a* may connect directly to line 54*a*, or may connect via intermediate signal conditioning or processing circuitry 58', such as amplification, phase inversions, delay or integration circuitry, or a microprocessor. As with the embodiment of FIG. 1A, the amount of strain energy achievable by driving the strain element 54 may amount of only a small percentage, e.g., one to five percent, of the strain naturally excited in use of the ski, and this effect might not be expected to result in an observable or useful change in the response of a sports implement. Applicant has found, however that proper selection of the region R and subregions 53 and 55 several effective controls are achieved. A general technique for identifying and determining locations for these regions in a sports implement will be discussed further below.

Figure 1D:
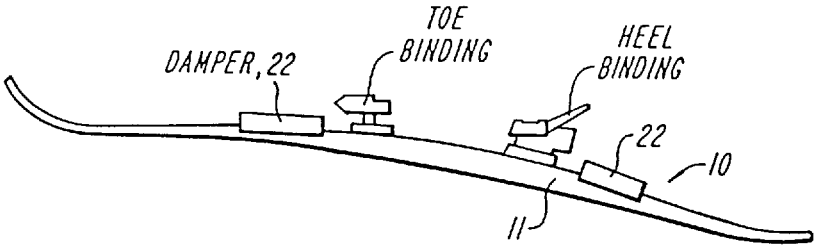
FIG. 1D shows another ski embodiment of the invention.
Figure 1C:
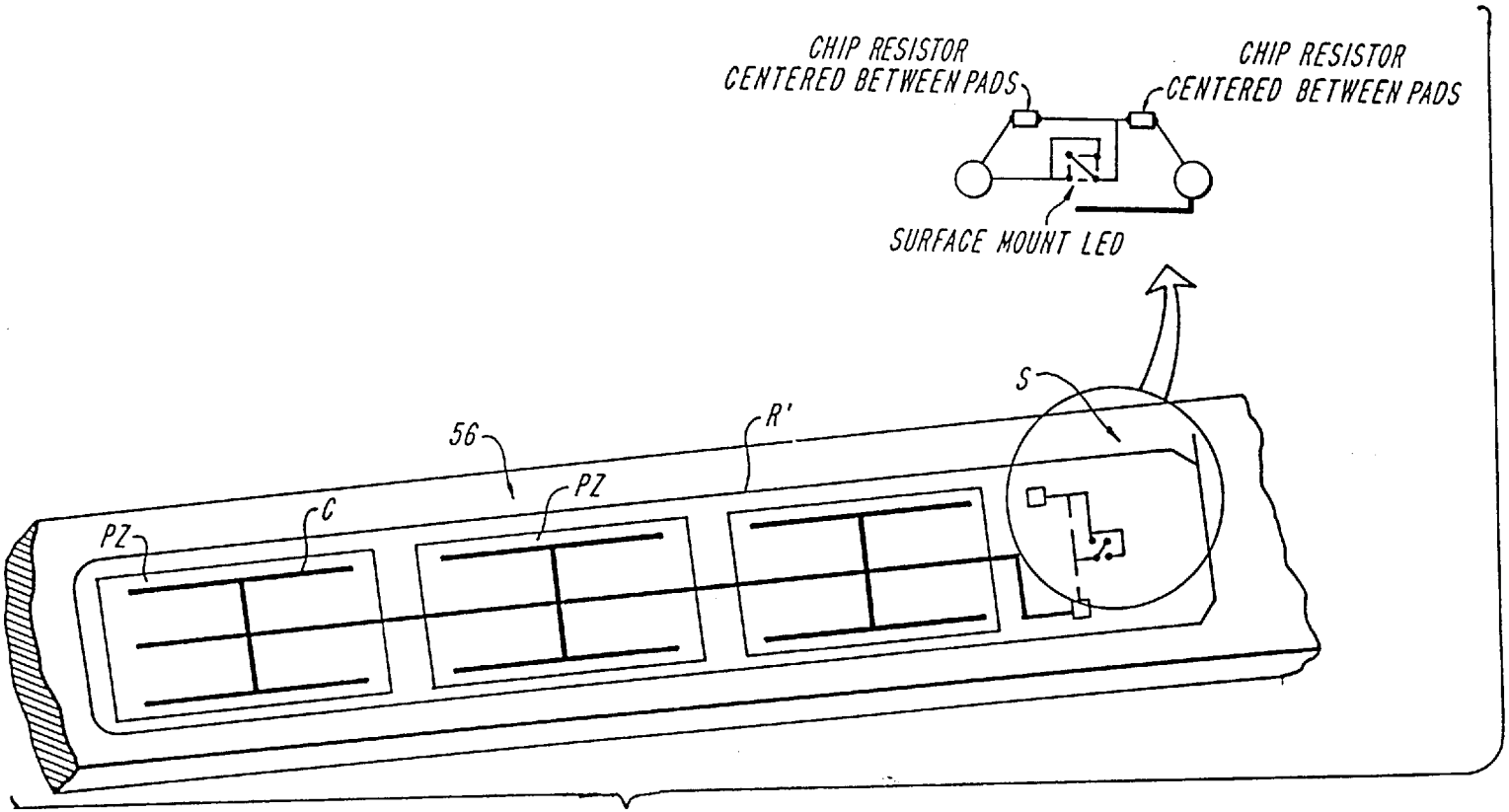

As further shown in FIG. 1D, other embodiments of an adaptive ski may be implemented having electroactive assemblies 22 located in several regions, both ahead of and behind the root area. This allows a greater portion of the strain energy to be captured, and dissipated or otherwise affected.

Figure 5A:
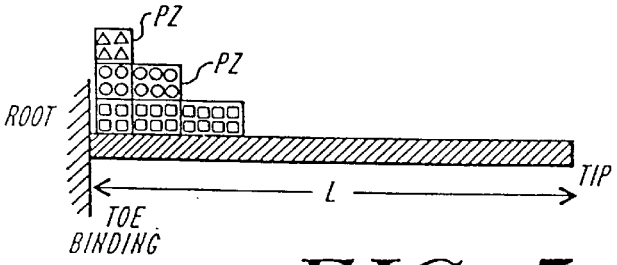
FIGS. 5A–C illustrate one strain actuator placement in relation to strain magnitude.
Figure 5C:
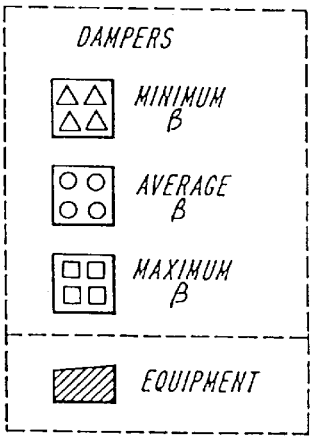
Figure 5B:
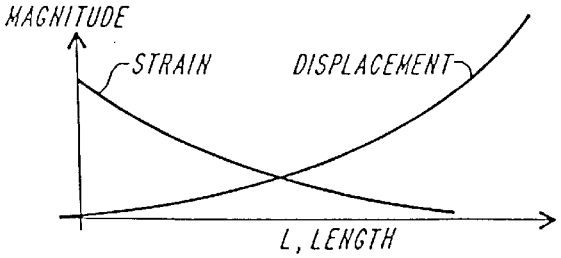

In general, the amount of strain which can be captured from or applied to the body of the ski will depend on the size and location of the electroactive assemblies, as well as their coupling to the ski. FIG. 5A illustrates strain and displacement along the length of a ski as a function of distance L from the root to the tip. A corresponding construction for the electroactive assembly is illustrated, and shows between one and three layers of strain actuator material PZ, with a greater number of layers in the regions of higher strain. In practice, rather than such a tailored construction, applicant has found that it is adequate to position a relatively short assembly-six or eight inches long-in a region of high strain, where the assembly has a constant number of piezo layers along its length. In prototype embodiments, applicant employed a one-layer assembly for the passive (shunted) damper, and a three-layer assembly for the actively driven embodiment. Such electroactive assemblies of uniform thickness are more readily fabricated in a heated lamination press to withstand extreme physical conditions.

Figure 2A:
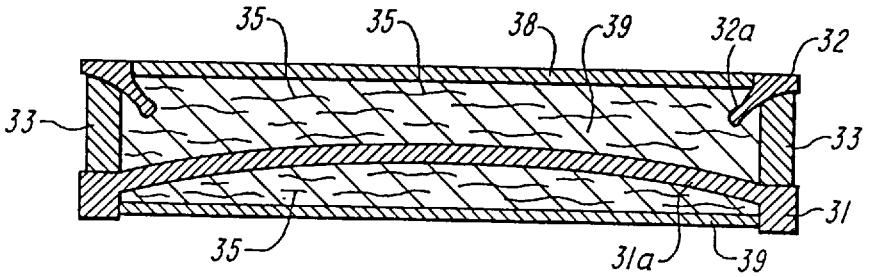
FIGS. 2A–2C shows sections through the ski of FIG. 1.
Figure 2B:
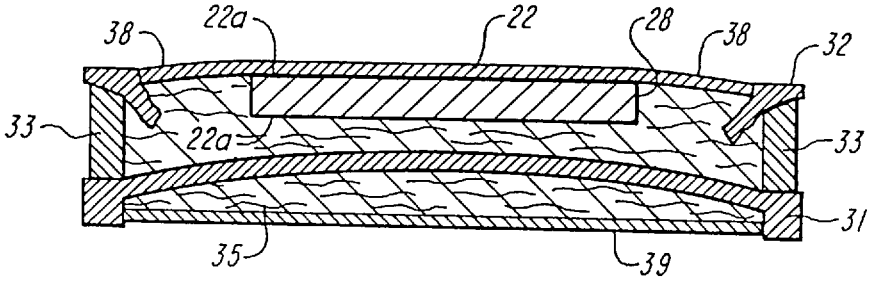
Figure 2C:
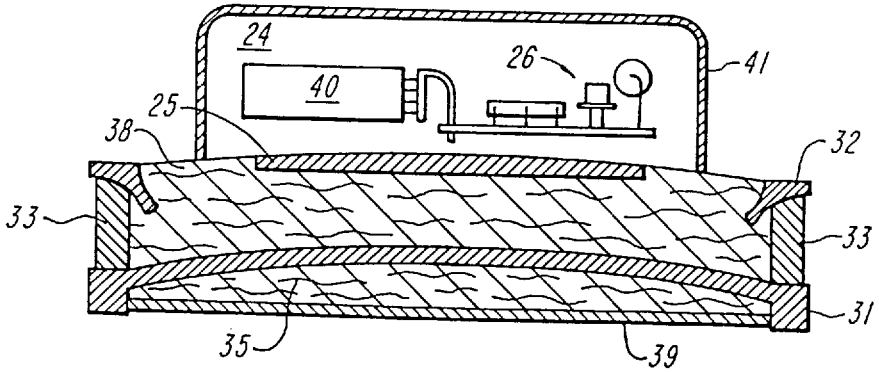

Returning now to the ski shown in FIG. 1, various sections are shown in FIGS. 2A–2C through the forepart of that ski illustrating the cross sectional structure therein. Two types of structures appear. The first are structures forming the body, including runners and other elements, of the ski itself. All of these elements are entirely conventional and have mechanical properties and functions as known in the prior art. The second type of element are those forming or especially adapted to the electroactive sheet elements which are to control the ski. These elements, including insulating films spacers, support structures, and other materials which are laminated about the piezoelectric elements preferably constitute modular or packaged piezo assemblies which are identical to or similar to those described in the aforesaid patent application documents. Advantageously, the latter elements together form a mechanically stiff but strong and laminated flexible sheet. As such they are incorporated into the ski with its normal stiff epoxy or other body material thereof, forming an integral part of the ski body and thereby avoiding any increased weight or performance penalty or loss of strength, while providing the capability for electrical control of the ski's mechanical parameters. This property will be understood with reference to FIGS. 2A–2C.

FIG. 2A shows a section through the forepart of ski 11, in a region where no other mounting or coupling devices are present. The basic ski construction includes a hard steel runner assembly 31 which extends along each side of the ski, and an aluminum edge bead 32 which also extends along each side of the ski and provides a comer element at the top surface thereof. Edge bead 32 may be a portion of an extrusion having projecting fingers or webs 32*a* which firmly anchor and position the bead 32 in position in the body of the ski. Similarly, the steel runner 31 may be attached to or formed as part of a thin perforated sheet structure 31*a* or other metal form having protruding parts which anchor firmly within the body of the skis. The outside edge of the extrusion 32 is filled with a strong non-brittle flowable polymer 33 which serves to protect the aluminum and other parts against weathering and splitting, and the major portion of the body of the ski is filled one or more laminations of strong structural material 35 which may comprise layers of kevlar or similar fabric, fibers of kevlar material, and strong cross-linkable polymer such as an epoxy, or other structural material known in the art for forming the body of the ski. This material 35 generally covers and secures the protruding fingers 32*a* of the metal portion running around the perimeter of the ski. The top of the ski has a layer of generally decorative colored polymer material 38 of low intrinsic strength but high resistance to impact which covers a shallow layer and forms a surface finish on the top of the ski. The bottom of the ski has a similar filled region 39 formed of a low friction polymer having good sliding qualities on snow and ice. In general, the runner 31, edging 32 and structural material 35 form a stiff strong longitudinal plate which rings or resonates strongly in a number of modes when subjected to the impacts and lateral scraping contact impulses of use.

FIG. 2B shows a section taken at position more centrally located along the body of the ski. The section here differs, other than in the slight dimensional changes due to tapering of the ski along its length, in also having an electroactive assembly element 22 together with its supply or output electrode material 22*a* in the body of the ski. As shown in the FIG., the electroactive assembly 22 is embedded below the cover layer 38 of the ski in a recess 28 so that they contact the structural layer 35 over a broad contact area and are directly coupled thereto with an essentially sheer-free coupling. The electrodes connected to the assembly 22 also lie below the surface; this assures that the electroactive assembly is not subject to damage when the skier crosses his skis or otherwise scrapes the top surface of the ski. Furthermore, by placing the element directly in contact with or embedded in the internal structural layer 35, a highly efficient coupling of strain energy thereto is obtained. This provides both a high degree of structural stiffness and support, and the capability to efficiently alter dynamic properties of the ski as a whole. As noted above, in some ski constructions layer 38 tends to be less hard and such a layer 38 would therefore dissipate strain energy that was surface coupled to it without affecting ski mechanics. However, where the top surface is also a stiff polymer, such as a glass/epoxy material, the actuator can be directly cemented to the top surface.

FIG. 2C shows another view through the ski closer to the root or central position thereof. This view shows a section through the power module 24, which is mounted on the surface of the ski, as well as through the sensor 25, which like element 22 is preferably below the surface thereof. As shown, the control or power module 24 includes a housing 41 mounted on the surface and a battery 40 and circuit elements 26 optionally therein, while the electroactive sensor 25 is embedded below the surface, i.e., below surface layer 38, in the body of the ski to detect strain occurring in the region. The active circuit elements 26 may include elements for amplifying the level of signal provided to the actuator and processing elements, for phase-shifting, filtering and switching, or logic discrimination elements to actively apply a regimen of control signals determined by a control law to the electroactive elements 25. In the latter case, all or a portion of the controller circuitry may be distributed in or on the actuator or sensing elements of the electroactive assembly itself, for example as embedded or surface mounted amplifying, shunting, or processing elements as described in the aforesaid U.S. patent application. The actuator element is actuated either to damp the ski, or change its dynamic stiffness, or both. The nature and effect of this operation will be understood from the following.

To determine an effective implementation—to choose the size and placement for active elements as well as their mode of actuation—the ski may first modeled in terms of its geometry, stiffness, natural frequencies, baseline damping and mass distribution. This model allows one to derive a strain energy distribution and determine the mode shape of the ski itself. From these parameters one can determine the added amount of damping which may be necessary to control the ski. By locating electroactive assemblies at the regions of high strain, one can maximize the percentage of strain energy which is coupled into a piezoceramic element mounted on the ski for the vibrational modes of interest. In general by covering a large area with strain elements, a large portion of the strain energy in the ski can be coupled into the electroactive elements. However, applicant has found it sufficient in practice to deal with lower order modes, and therefore to cover less than fifty percent of the area forward of toe area with actuators. In particular, from the strain energy distribution of the modes of concern, for example the first five or ten vibrational modes of the ski structure, the areas of high strain may be determined. The region for placement of the damper is then selected based on the strain energy, subject to other allowable placement and size constraints. The net percent of strain energy in the damper may be calculated from the following equation:

$$\%SE_d=(EI_d/EI_s)^* \ \%SE_s(\text{in damper region})^*\beta \quad (1)$$

By multiplying this number by the damping factor of the electroactive assembly configured for damping, the damping factor for the piece of equipment is found.

$$\eta_s=\eta_d{}^*\%SE_d \quad (2)$$

Figure 3:
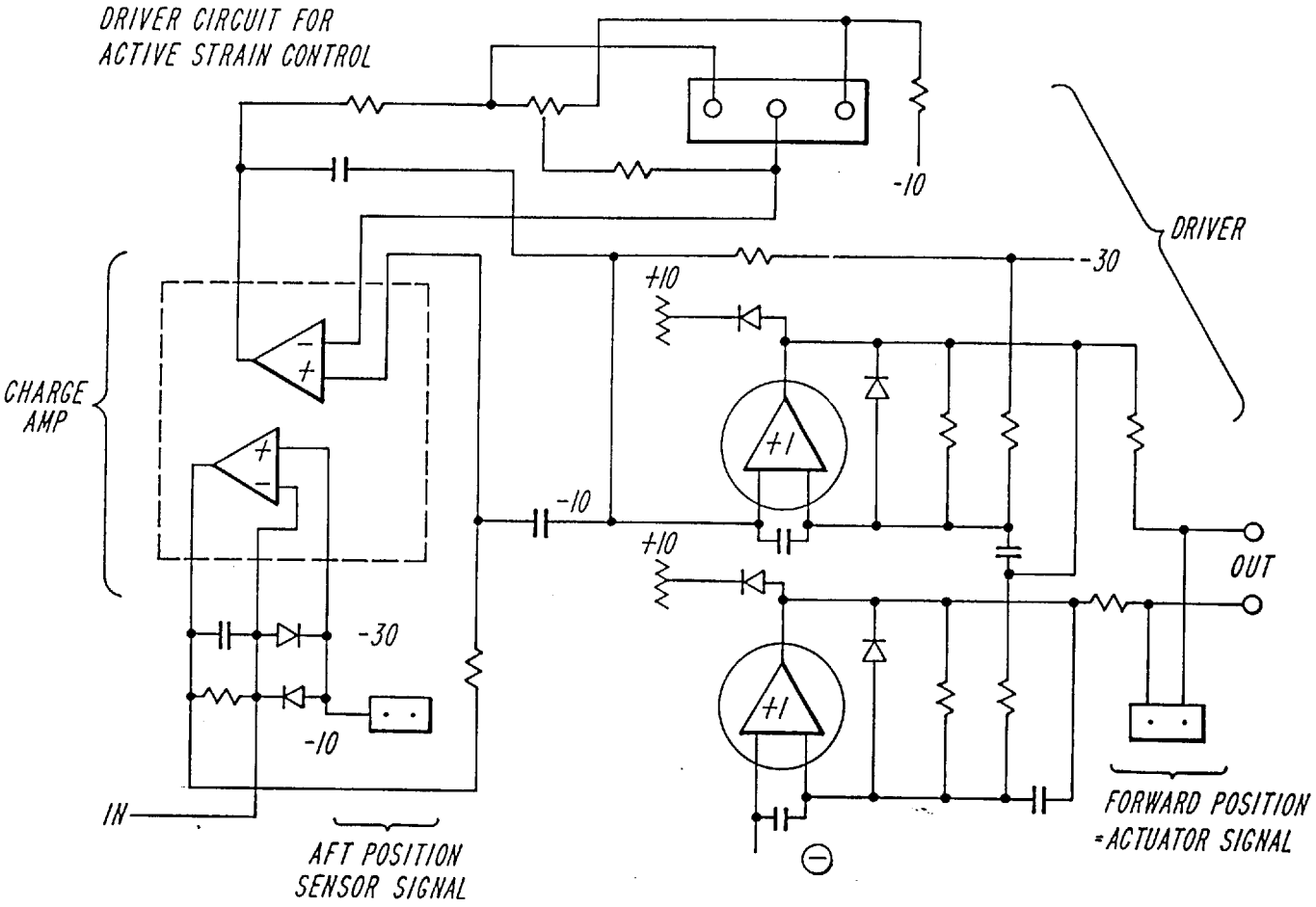
FIG. 3 schematically shows a circuit for driving the ski of FIG. 1B.
Figure 4:
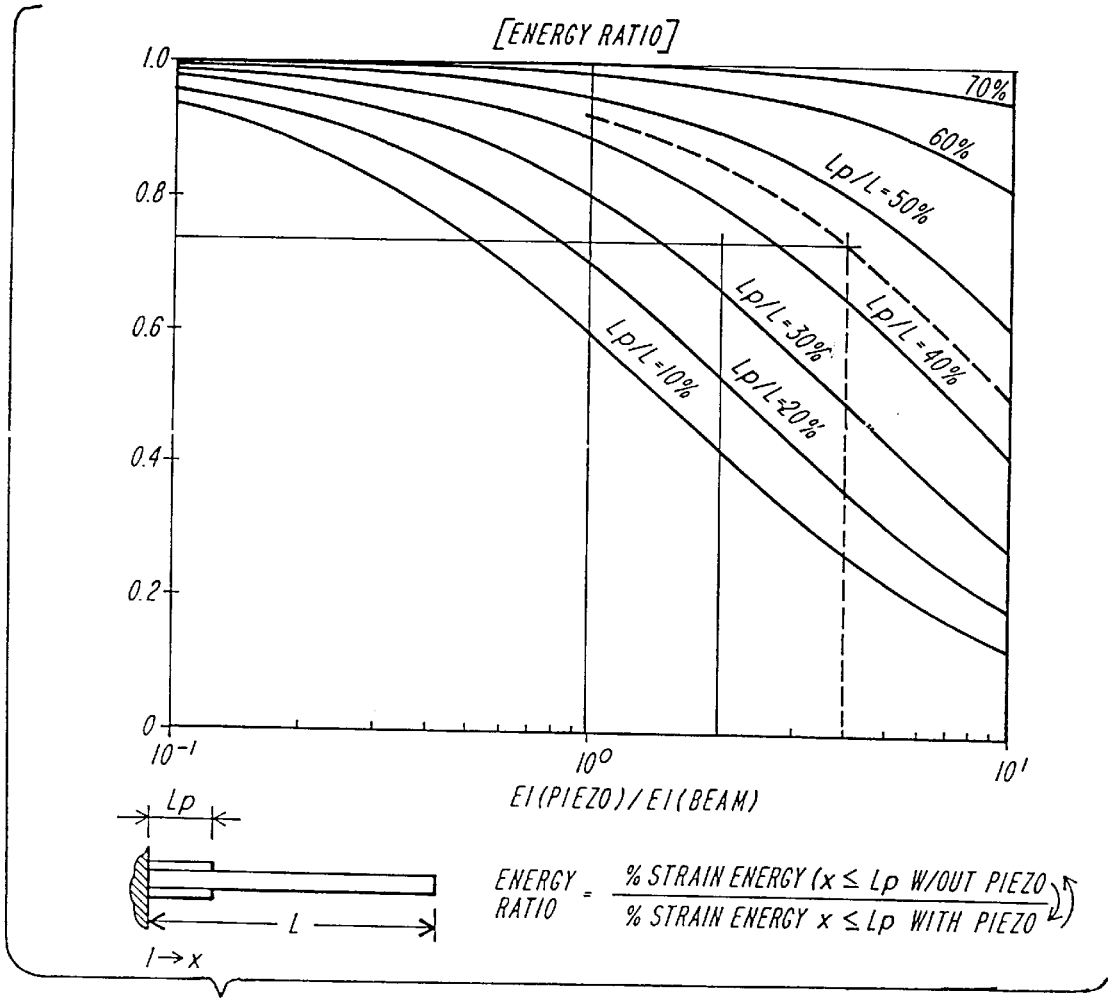
FIG. 4 models energy ratio for actuators of different lengths.
Figure 5:
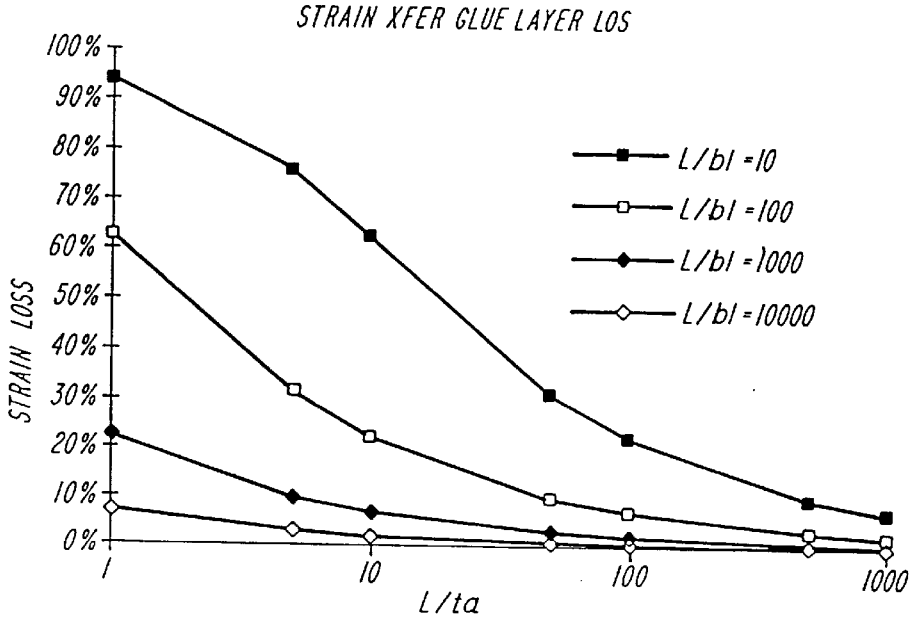
FIG. 5 models strain transfer loss for a glued-on actuator assembly.

The other losses β are a function of (a) the relative impedance of the piece of equipment and the damper $[EI_d/EI_s]$ and (b) the thickness and strength of the bonding agent used to attach the damper. Applicant has calculate impedance losses using FEA models, and these are due to the redistribution of the strain energy which results when the damper is added. A loss chart for a typical application is shown in FIG. 3. Bond losses are due to energy being absorbed as shear energy in the bond layers between actuator and ski body, and are found by solving the differential equation associated with strain transfer through material with significant shearing. The loss is equal to the strain loss squared and depends on geometric parameters as shown in FIG. 4. The losses β have the effect of requiring the damper design to be distributed over a larger area, rather than simply placing the thickest damper on the highest strain area. This effect is shown in FIG. 5.

The damping factor of the damper depends on its dissipation of strain energy. In the passive construction of FIG. 1A, dissipation is achieved with a shunt circuit attached to the electroactive elements. Typically, the exact vibrational frequencies of a sports implement are not known or readily observable due to the variability of the human using it and the conditions under which it is used, so applicant has selected a broad band passive shunt, as opposed to a narrow band tuned-mass-damper type shunt. The best such shunt is believed to be just a resistor tuned in relation to the capacitance of the piezo sheet, to optimize the damping in the damper near the specific frequencies associated with the modes to be damped. The optimal shunt resistor is found from the vibration frequency and capacitance of the electroactive element as follows:

$$R_{opt}=al^*\ (1/(\omega c)) \quad (3)$$

where the constant al depends on the coupling coefficient of the damping element.

In a prototype employing a piezoceramic damper module as described in the above-referenced patent application, the shunt circuit is connected to the electroactive elements via flex-circuits which, together with epoxy and spacer material, form an integral damper assembly. Preferably an LED is placed across the actuator electrodes, or a pair of LEDs are placed across legs of a resistance bridge to achieve a bipolar LED drive at a suitable voltage, so that the LED flashes to indicate that the actuator is strained and shunting, i.e., that the damper is operating. This configuration is shown in FIG. 1A by LED 70.

Figure 6:
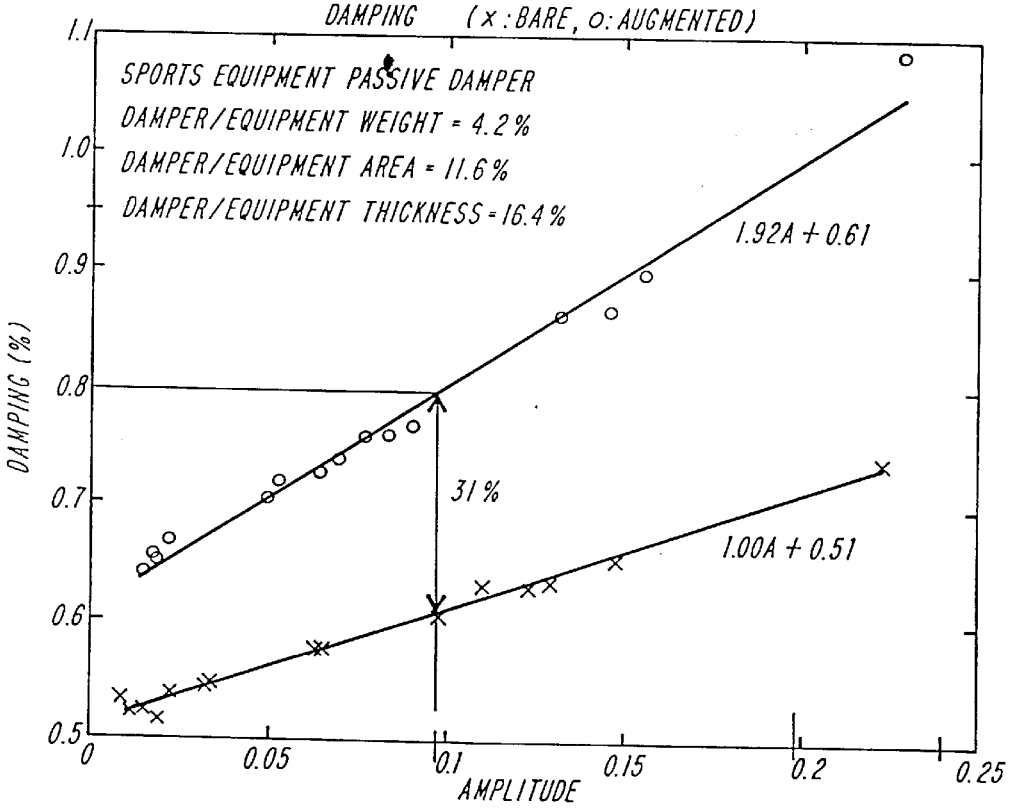
FIG. 6 shows damping achieved with a passive shunt embodiment.
Figure 6A:
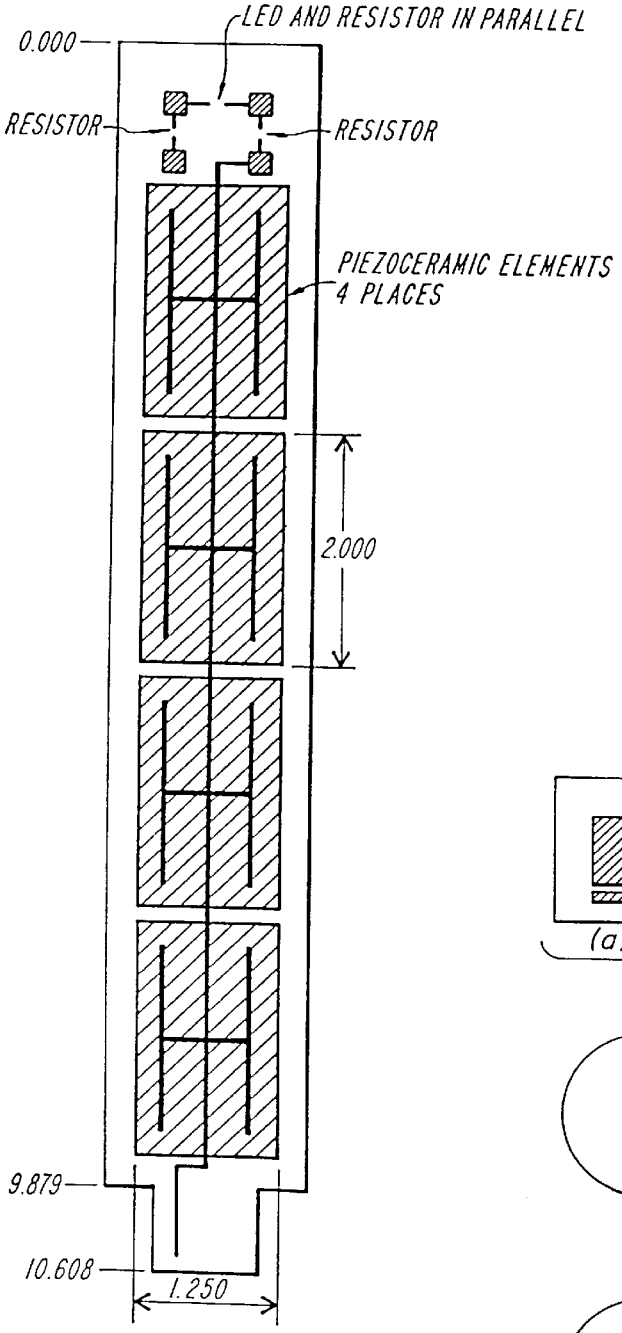
FIG. 6A illustrates the actuator assembly for the embodiment of FIG. 6.

A prototype embodiment of the sports damper for a downhill ski as shown in FIG. 1A was constructed. Damping measurements on the prototype, with and without the damper, were measured as shown in FIG. 6. The damper design added only 4.2% in weight to the ski, yet was able to add 30% additional damping. The materials of which the ski was manufactured were relatively stiff, so the natural level of damping was below one percent. The additional damping due to a shunted piezoelectric sheet actuator amounted to about one-half to one percent damping, and this small quantitative increase was unexpectedly effective to decrease vibration and provide greater stability of the ski. The aforesaid design employed electroactive elements over approximately 10% of the ski surface, with the elements being slightly over 1/16th of an inch thick, and, as noted, it increased the level of damping by a factor of approximately 30%. This embodiment did not utilize a battery power pack, but instead employed a simple shunt resistance to passively dissipate the strain energy entering the electroactive element. FIG. 6A shows the actuator layout with four 1¼"×2" sheets attached to the toe area.

A prototype of the active embodiment of the invention was also made. This employed an active design in which the element could be actuated to either change the stiffness of the equipment or introduce damping. The former of these two responses is especially useful for shifting vibrational modes when a suitable control law has been modeled previously or otherwise determined, for effecting dynamic compensation. It is also useful for simply changing the turning or bending resistance, e.g. for adapting the ski to perform better slalom or mogul turns, or alternatively grand slalom or downhill handling. The active damper employed a battery power pack as illustrated in FIGS. 1B and 2, and utilized a simply 9-volt battery which could be switched ON to power the circuitry. Overall the design was similar to that of the passive damper, with the actuator placed in areas of high strain for the dynamic modes of interest. Typically, only the first five or so structural modes of the ski need be addressed, although it is straightforward to model the lowest fifteen or twenty modes. Impedance factors and shear losses enter into the design as before, but in general, the size of actuators is selected based on the desired disturbance force to be applied rather than the percent of strain energy which one wishes to capture, taking as a starting point that the actuator will need enough force to move the structure by about fifty percent of the motion caused by the average disturbance (i.e., to double the damping or stiffness). The actuator force can be increased either by using a greater mass of active piezo material, or by increasing the maximum voltage generated by the drive amplifier. Thus there is a trade-off in performance with power consumption or with the mass of the electroactive material. Rather than achieve full control, applicant therefore undertook to optimize the actuator force in this embodiment, subject to practical considerations of size, weight, battery life and cost constraints. This resulted in a prototype embodiment of the active, or powered, damper as follows.

Figure 7:
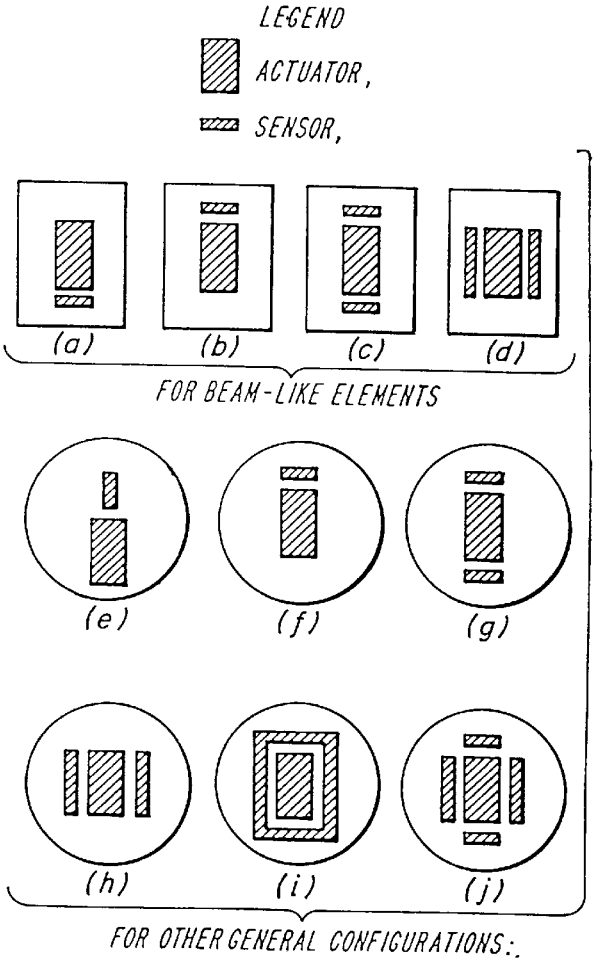
FIG. 7(*a*)–7(*j*) show general actuator/sensor configurations adapted for differently shaped sports implements.

The basic architecture employed a sensor to sense strain in the ski, a power amplifier/control module and an actuator which is powered by the control module, as illustrated in FIG. 1B. Rather than place the sensor inside the local strain field of the actuator so that it directly senses strain occurring at or near the actuator, applicant placed the sensor outside of the strain field but not so far away that any nodes of the principal structural modes of the ski would appear between the actuator and the sensor. Applicant refers to such a sensor/actuator placement, i.e., located closer to the actuator than the strain nodal lines for primary modes, as an "interlocated" sensor. The sensor "s" may be ahead of, behind, both ahead of and behind, or surrounding the actuator "a", as illustrated in the schematic FIG. 7(*a*)–(*j*). In one practical embodiment, the actuator itself was positioned at the point on the ski where the highest strains occur in the modes of interest. For a commercially available ski, the first mode had its highest strain directly in front of the boot. However, in building the prototype embodiment, to accommodate constraints on available placement locations, applicant placed the actuator several inches further forward in a position where it was still able to capture 2.4% of the total strain energy of the first mode. An interlocated sensor was then positioned closer to the boot to sense strain at a position close enough to the actuator that none of the lower frequency mode strain node lines fell between the sensor and the actuator. As a control driving arrangement, this combination produced a pair of zeros at zero Hertz (AC coupling) and an interlaced pole/zero pattern up to the first mode which has strain node line between the sensor and actuator. The advantage of this arrangement is that when a controller with a single low frequency pole (e.g., a band limited integrator) is combined with the low frequency pair of zeros, a single zero is left to interact with the flexible dynamics of the ski. This single zero effectively acts as rate feedback and damping. However, since the control law itself is an integrator, it is inherently insensitive to high frequency noise and no additional filtering is needed. The absence of filter eliminates the possibility of causing a high frequency instability, thus assuring that, although incompletely modeled and subject to variable boundary conditions, the active ski has no unexpected instability.

For this ski, it was found that placing the sensor three to four inches away from the actuator and directly in front of the binding produce the desired effect. A band limited integrator with a corner frequency of 5 Hz., well below the first mode of the ski at 13 Hz. was used as a controller. The controller gain could be varied to induce anywhere from 0.3% to 2% of active damping. The limited power available from the batteries used to operate the active control made estimation of power requirements critical. Conservative estimates were made assuming the first mode was being excited to a high enough level to saturate the actuators. Under this condition, the controller delivers a square wave of amplitude equal to the supply voltage to a capacitor. The power required in this case is:

$$P = \frac{\omega C v^2}{\pi}$$

where C is the actuator capacitance and ω is the modal frequency in radians per second.

The drive was implemented as a capacitance charge pump having components of minimal size and weight and being relatively insensitive to vibration, temperature, humidity, and battery voltage. A schematic of this circuit is shown in FIG. 3. The active control input was a charge amplifier to which the small sensing element could be effectively coupled at low frequencies. The charge amp and conditioning electronics both run off lower steps on the charge pump ladder than the actual amplifier output, to keep power consumption of this input stage small. Molded axial solid tantalum capacitors where used because of their high mechanical integrity, low leakage, high Q, and low size and weight. An integrated circuit was used for voltage switching, and a dual FET input op amp was used for the signal processing. The output drivers were bridged to allow operation from half the supply voltage thus conserving the supply circuitry and power. Resistors were placed at the output to provide a stability margin, to protect against back drive and to limit power dissipation. Low leakage diodes protected the charge amp input from damage. These latter circuit elements function whether the active driving circuit is ON or OFF, a critical feature when employing piezoceramic sensors that remain connected in the circuitry. An ordinary 9-volt clip-type transistor radio battery provided power for the entire circuit, with a full-scale drive output of 30–50 volts.

Figure 8:
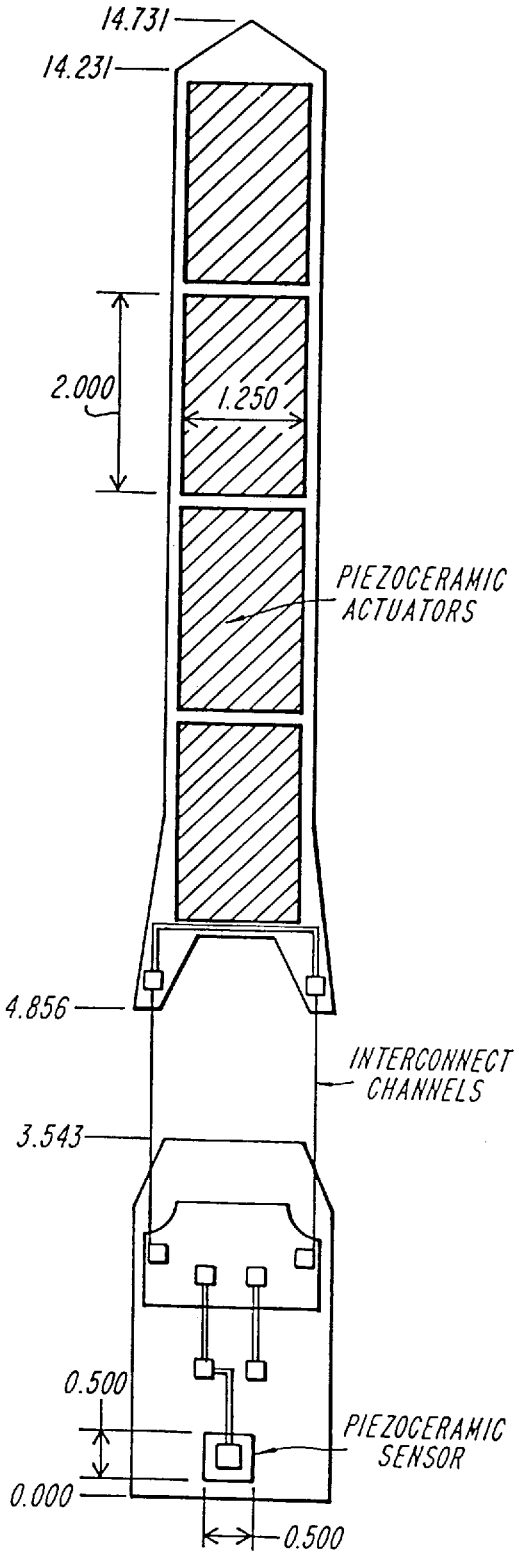
FIG. 8 shows an actuator/circuit/sensor layout in a prototype active embodiment.
Figure 8A:
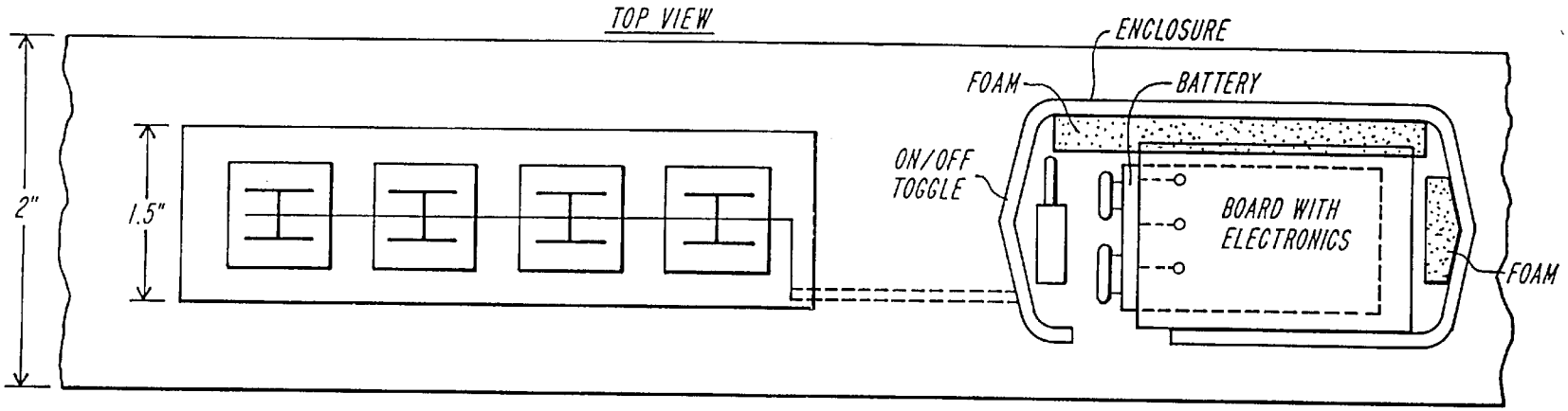
FIGS. 8A and 8B show top and sectional views of the assembly of FIG. 8 mounted in a ski.
Figure 8B:
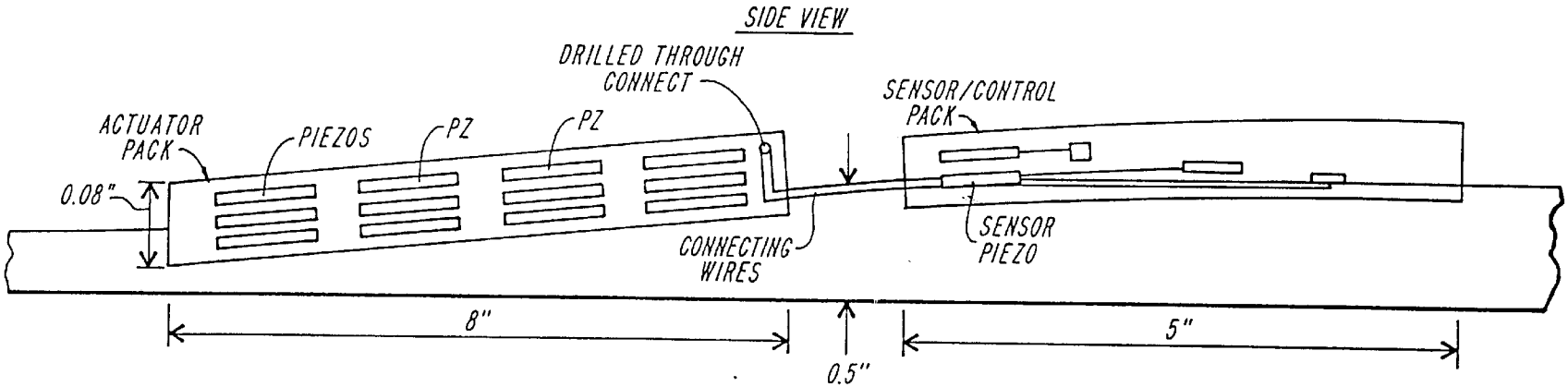

Layout of the actuator/sensor assembly of the actively-driven prototype is shown in FIGS. 8, 8A and 8B. An actuator similar in construction and dimensions to that of FIG. 6A was placed ahead of the toe release, and lead channels were formed in the ski's top surface to carry connectors to a small interlocated piezoceramic strain sensor, which was attached to the body of the ski below the power/control circuit box, shown in outline. The electroactive assembly included three layers each containing four PZT wafers and was embedded in a recess approximately two millimeters deep, with its lower surface directly bonded to the uppermost stiff structural layer within the ski's body. The provision of three layers in the assembly allowed a greater amount of strain energy to be applied.

Field testing of the ski with the active damper arrangement provided surprising results. Although the total amount of strain energy was under five percent of the strain energy in the ski, the damping affect was quite perceptible to the skiers and resulted in a sensation of quietness, or lack of mechanical vibration that enhanced the ski's performance in terms of high speed stability, turning control and comfort. In general, the effect of this smoothing of ski dynamics is to have the running surfaces of the ski remain in better contact with the snow and provide overall enhanced speed and control characteristics.

The prototype embodiment employed approximately a ten square inch actuator assembly arrayed over the fore region of a commercial ski, and was employed on skis having a viscoelastic isolation region that partially addressed impact vibrations. Although the actuators were able to capture less than five percent of the strain energy, the mechanical effect on the ski was very detectable in ski performance.

Greater areas of actuator material could be applied with either the passive or the active control regimen to obtain more pronounced damping affects. Furthermore, as knowledge of the active modes a ski becomes available, particular switching or control implementation may be built into the power circuitry to specifically attack such problems as resonant modes which arise under particular conditions, such as hard surface or high speed skiing.

The actuator is also capable of selectively increasing vibration. This may be desirable to excite ski modes which correspond to resonant undulations that may in certain circumstances reduce frictional drag of the running surfaces. It may also be useful to quickly channel energy into a known mode and prevent uncontrolled coupling into less desirable modes, or those modes which couple into the ski shapes required for turning.

In addition to the applications to a ski described in detail above, the present invention has broad applications as a general sports damper which may be implemented by applying the simple modeling and design considerations as described above. Thus, corresponding actuators may be applied to the runner or chassis of a luge, or to the body of a snowboard or cross country ski. Furthermore, electroactive assemblies may be incorporated as portions of the structural body as well as active or passive dampers, or to change the stiffness, in the handle or head of sports implements such as racquets, mallets and sticks for which the vibrational response primarily affects the players' handling rather than the object being struck by the implement. It may also be applied to the frame of a sled, bicycle or the like. In each case, the sports implement of the invention is constructed by modeling the modes of the sports implement, or detecting or determining the location of maximal strain for the modes of interest, and applying electroactive assemblies material at the regions of high strain, and shunting or energizing the material to control the device.

Rather than modeling vibrational modes of a sports implement to determine an optimum placement for a passive sensor/actuator or an active actuator/sensor pair, the relevant implement modes may be empirically determined by placing a plurality of sensors on the implement and monitoring their responses as the implement is subjected to use. Once a "map" of strain distribution over the implement and its temporal change has been compiled, the regions of high strain are identified and an actuator is located, or actuator/sensor pair interlocated there to affect the desired dynamic response.

A ski interacts with its environment by experiencing a distributed sliding contact with the ground, an interaction which applies a generally broad band excitation to the ski. This interaction and the ensuing excitation of the ski may be monitored and recorded in a straightforward way, and may be expected to produce a relatively stable or slowly evolving strain distribution, in which a region of generally high strain may be readily identified for optional placement of the electroactive assemblies. A similar approach may be applied to items such as bicycle frames, which are subject to similar stimuli and have similarly distributed mechanics.

An item such as mallet or racquet, on the other hand, having a long beam-like handle and a solid or web striking face at the end of the handle, or a bat with a striking face in the handle, generally interacts with its environment by discrete isolated impacts between a ball and its striking face. As is well known to players, the effect of an impact on the implement will vary greatly depending on the location of the point of impact. A ball striking the "sweet spot" of a racquet or bat will efficiently receive the full energy of the impact, while a glancing or off-center hit with a bat or racquet can excite a vibrational mode that further reduces the energy of the hit and also makes it painful to hold the handle. For these implements, the discrete nature of the exciting input makes it possible to excite many longitudinal modes with relatively high energy. Furthermore, because the implement is to be held at one end, the events which require damping for reasons of comfort, will in general have high strain fields at or near the handle, and require placement of the electroactive assembly in or near that area. However, it is also anticipated that a racquet may also benefit from actuators placed to damp circumferential modes of the rim, which may be excited when the racquet nicks a ball or is impacted in an unintended spot. Further, because any sports implement, including a racquet, may have many excitable modes, controlling the dynamics may be advantageous even when impacted in the desired location. Other sports implements to which actuators are applied may include luges or toboggans, free-moving implements such as javelins, poles for vaulting and others that will occur to those skilled in the art.

Figure 9:
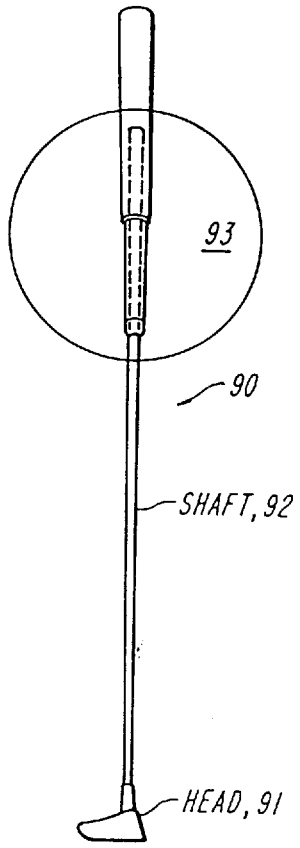
FIG. 9 shows a golf club embodiment of the invention.
Figure 9A:
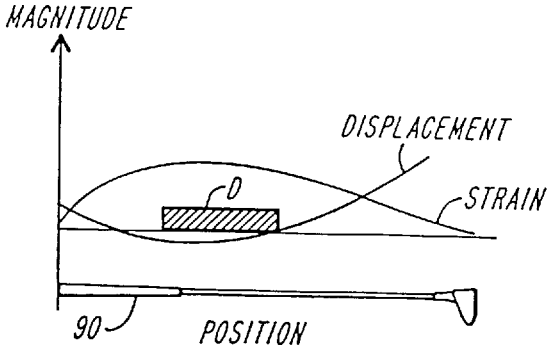
FIG. 9A illustrates strain characteristics thereof.
Figure 9B:
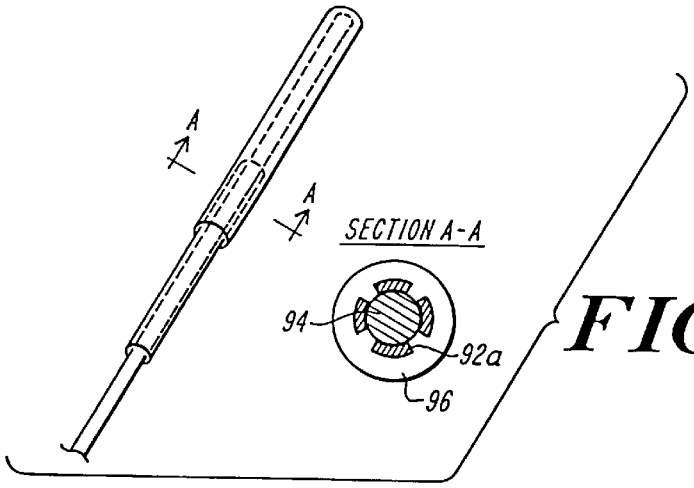
FIG. 9B shows details thereof in sectional view.

FIG. 9 illustrates a golf club embodiment 90 in accordance with the present invention. Club 90 includes a head 91, an elongated shaft 92, and a handle assembly 95 with an actuator region 93. FIG. 9A shows the general distribution of strain and displacement experienced by the club upon impact, e.g. those of the lowest order longitudinal mode, somewhat asymmetric due to the characteristic mass distribution and stiffness of the club, and the user's grip which defines a root of the assembly. In this embodiment an electroactive assembly is positioned in the region 93 corresponding to region "D" (FIG. 9A) of high strain near the lower end of the handle. FIG. 9B illustrates such a construction. As shown in cross-section, the handle assembly 95 includes a grip 96 which at least in its outermost layers comprises a generally soft cushioning material, and a central shaft 92*a* held by the grip. A plurality of arcuate strips 94 of the electroactive assembly are bonded to the shaft and sealed within a surrounding polymer matrix, which may for example be a highly crosslinked structural epoxy matrix which is hardened in situ under pressure to maintain the electroactive elements 94 under compression at all times. As in the ski embodiment of FIG. 1A, the elements 94 are preferably shunted to dissipate electrical energy generated therein by the strain in the handle.

The actuators may also be powered to alter the stiffness of the club. In general, when applied to affect damping, increased damping will reduce the velocity component of the head resulting from flexing of the handle, while reduced damping will increase the attainable head velocity at impact. Similarly, by energizing the actuators to change the stiffness, the "timing" of shaft flexing is altered, affecting the maximum impact velocity or transfer of momentum to a struck ball.

Figure 10:
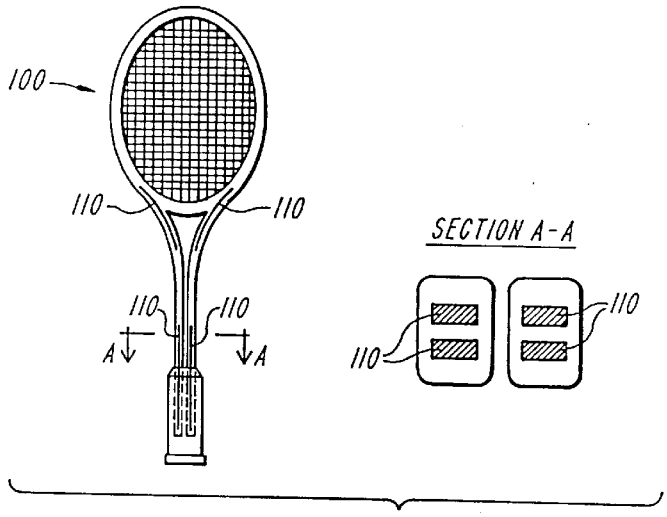
FIG. 10 shows a racquet embodiment of the invention.
Figure 10A:
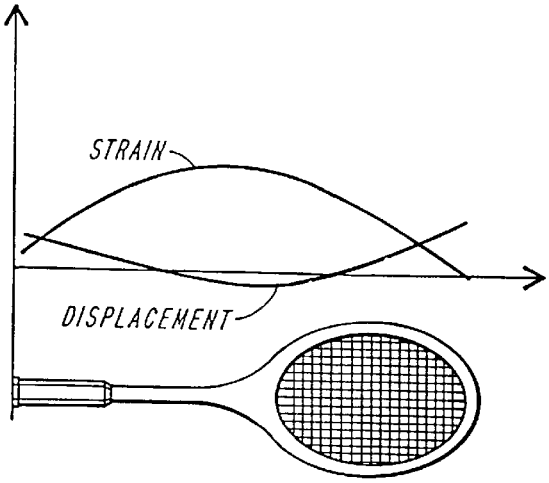
FIG. 10A illustrates strain characteristics thereof.

FIG. 10 illustrates representative constructions for a racquet embodiment 100 of the present invention. For this implement, actuators 110 may be located proximate to the handle and/or proximate to the neck. In general, it will be desirable to dampen the vibrations transmitted to the root which result form impact. FIG. 10A shows representative strain/displacement magnitudes for a racquet.

Figure 11:
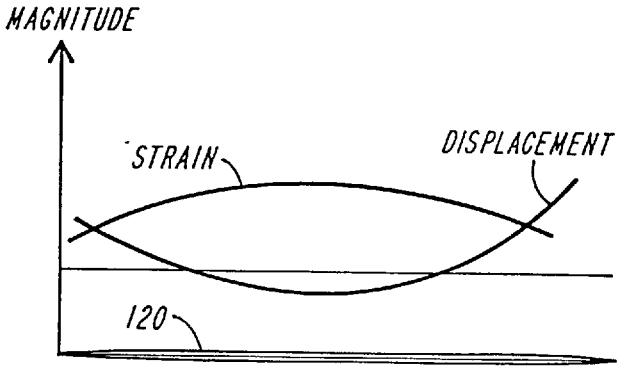
FIG. 11 shows a javelin embodiment of the invention and illustrates strain characteristics thereof.

A javelin embodiment 120 is illustrated in FIG. 11. This implement differs from any of the striking or riding implements in that there is no root position fixed by any external weight or grip. Instead the boundary conditions are free and the entire body is a highly excitable tapered shaft. The strain/displacement chart is representative, although many flexural modes may be excited and the modal energy distribution can be highly dependent on slight aberrations of form at the moment the javelin is thrown. For this implement, however, the modal excitation primarily involves ongoing conversion or evolution of mode shapes during the time the implement is in the air. The actuators are preferably applied to passively damp such dynamics and thus contribute to the overall stability, reducing surface drag.

Figure 12:
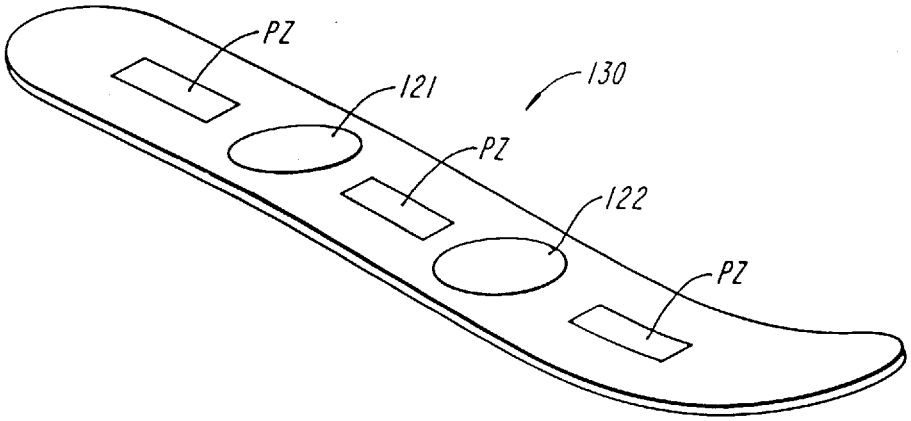
FIG. 12 shows a ski board embodiment of the invention.

FIG. 12 shows a snow board embodiment 130. This sports implement has two roots, given by the left and right boot positions 121, 122, although in use weight may be shifted to only one at some times. Optimal actuator positions cover regions ahead of, between, and behind the boot mountings.

As indicated above for the passive constructions, control is achieved by coupling strain from the sports implement in use, into the electroactive elements and dissipating the strain energy by a passive shunt or energy dissipation element. In an active control regiment, the energy may be either dissipated or may be effectively shifted, from an excited mode, or opposed by actively varying the strain of the region at which the actuator is attached. Thus, in other embodiments they may be actively powered to stiffer or otherwise alter the flexibility of the shaft.

The invention being thus disclosed and described, further variations will occur to those skilled in the art, and all such variations and modifications are consider to be with the spirit and scope of the invention described herein, as defined in the claims appended hereto.

What is claimed is:

1. A sports implement worn or held by a user and subject to contact and vibration, such implement comprising a unitary sports body, said sports body having an extent and including a contact surface which is subject in use to contact stimulation such that the body deforms and gives rise to a distribution of strain energy in said body including a local region of strain, wherein the distribution varies in use an electroactive assembly including a piezoelectric strain element for transducing electrical energy and mechanical strain energy, said electroactive assembly being integrated by a strain coupling to said body in said region of strain for receiving strain energy therefrom, and a circuit connected to said assembly for directing electrical energy via said assembly to control strain in the piezoelectric element so as to damp vibrational response of said body to said contact stimulation, said circuit including a shunt for dissipating charge generated in said element by strain coupled from said region, thereby reducing strain in said body in an amount effective to enhance performance of the sports implement.

2. A sports implement according to claim 1, wherein said unitar body has a root, and wherein said piezoelectric strain element is coupled to said body proximate to and extending away from the root.

3. A sports implement according to claim 1, which is selected from the group consisting of a ski, a monoboard and a snowboard.

4. A sports implement according to claim 1, wherein said stimulation excites structural modes of said body giving rise to said strain distribution, and said assembly and circuit means effectively alter strain to shift or damp excitation of modes and improve handling of said implement.

5. A sports implement according to claim 1, wherein said region of strain includes an area of high strain and said assembly includes a piezoelectric sheet coupled by a substantially shear free coupling across a face of the sheet into said unitary body in said area of high strain.

6. A sports implement according to claim 1, wherein said assembly is formed of stiff material such that when assembled into said body it provides structural stiffness to said sports body while effectively adding damping to said body.

7. A sports implement according to claim 1, wherein said contact surface includes a striking surface for striking an object in play, and said response includes handling of said implement or a response of the implement to said striking.

8. A sports implement according to claim 1, wherein said contact surface is a running surface which slides over a medium, and said piezoelectric strain element is positioned substantially parallel to said running surface.

9. A sports implement according to claim 8, wherein said altered response enhances travel speed of said body over said medium.

10. A sports implement according to claim 1, which is a racquet.

11. A sports implement according to claim 1, which is a club.

12. A sports implement according to claim 1, wherein said circuit means is embedded in said electroactive assembly.

13. A sports implement according to claim 1, wherein said strain element is attached by a substantially shear free coupling to said body for coupling in-plane strain therebetween.

14. A sports implement according to claim 1, wherein said piezoelectric strain element is a multi-layer sealed element.

15. A sports implement according to claim 1, wherein said piezoelectric strain element is a piezoceramic element and said circuit means drives said element.

16. A sports implement according to claim 1, wherein said assembly includes an electroactive strain sensor for sensing strain energy.

17. A sports implement according to claim 2, wherein said root is a position of said body stabilized against motion by a user holding or bearing against the root.

18. A sports implement according to claim 1, which is a snow ski and wherein said strain element is embedded in the body of the snow ski.

19. A sports implement according to claim 1, further comprising a sensor interlocated with said piezoelectric strain element for detecting a level of strain energy proximate to said region, and wherein said circuit means comprises a driver for driving said electroactive element in accordance with the level of strain energy sensed by the sensor.

20. A sports implement according to claim 1, further comprising a sensor for sensing a level of strain energy in said sports body, and wherein said circuit means comprises a driver for driving said electroactive strain element in accordance with the level of strain energy sensed by said sensor.

21. A sports implement according to claim 20, wherein said sensor is charged-coupled to said driver.

22. A sports implement according to claim 1, selected from among the implements: bicycle, ski, luge, racquet, mallet, golf club, stick and bat.

23. A sports implement worn or held by a user and subject to contact and vibration, such implement comprising a unitary sports body, said sports body having an extent and including a contact surface which is subject in use to contact stimulation such that the body deforms and gives rise to a distribution of strain energy in said body including a local region of strain, wherein the distribution varies in use an electroactive assembly including a piezoelectric strain element for transducing electrical energy and mechanical strain energy, said electroactive assembly being integrated by a strain coupling to said body in said region of strain for receiving strain energy therefrom, and a circuit connected to said assembly for directing electrical energy via said assembly to control strain in the piezoelectric element so as to damp vibrational response of said body to said contact stimulation in an amount effective to enhance performance of the sports implement, and further comprising an LED indicator placed across said electroactive assembly so that the LED is illuminated by the strain element to directly show transducing of mechanical strain energy to electrical energy by said electroactive assembly.

24. A sports implement comprising a sports body, said sports body having an extent and including a contact surface which is subject in use to stimulation such that the body deforms and gives rise to a distribution of strain energy in said body including a region of strain an electroactive assembly including an electroactive strain element for transducing electrical energy and mechanical strain energy, said electroactive assembly being coupled to said body in said region of strain circuit means for directing electrical energy via said assembly to effectively alter response of said body to said stimulation, and a sensor for sensing strain energy in said sports body wherein said circuit means comprises a driver for driving said electroactive strain element in accordance with the strain energy sensed by said sensor, wherein the circuit means utilizes a battery for providing power, and includes a multiplier for achieving a voltage higher than battery voltage to drive said strain element.

25. A sports implement comprising a sports body, said sports body having an extent and including a contact surface which is subject in use to stimulation such that the body deforms and gives rise to a distribution of strain energy in said body including a region of strain an electroactive assembly including an electroactive strain element for transducing electrical energy and mechanical strain energy, said electroactive assembly being coupled to said body in said region of strain, circuit means for directing electrical energy via said assembly to effectively alter response of said body to said stimulation, and a sensor for sensing strain energy in said sports body, and wherein said circuit means comprises a driver for driving said electroactive strain element in accordance with the strain energy sensed by said sensor, wherein said circuit means integrates a signal from said sensor at a frequency substantially below frequency of a lowest mode of said implement.

26. A ski having an elongated body with a top surface and a smooth flat running surface opposed thereto, the running surface extending from front to rear thereof, a mounting portion at a region of the top surface, and a damper attached to said body wherein the damper includes an assembly including at least one piezoelectric plate, said assembly being integrated into said elongated body such that the strain is effectively coupled between said body and a face of said plate, a sensor for sensing strain in the ski, the sensor being affixed to said ski proximate to said assembly at a position without nodal lines between said sensor and said assembly, and a circuit operative to control strain in said assembly and damp vibration of the ski in use.

27. A ski according to claim 26, wherein the ski has a neutral axis and said assembly is located away from the neutral axis covering a region effective to capture more than about one percent of strain energy of said ski.

28. A ski according to claim 26, which is a runner of a luge.

29. A ski comprising a ski body, said ski body having a vibrational resonant mode an assembly of at least one sheet of piezoceramic material coupled over a region of the ski body to partition strain energy therewith so as to generate electrical charge in accordance with changing strain in the ski body, and a shunt placed across said assembly to dissipate said electrical charge and effectively damp vibration of said resonant mode.

30. A ski according to claim 29, wherein said shunt is a resistive shunt forming a circuit tuned to frequency of said mode.

31. A ski according to claim 29, wherein said shunt is a broadband shunt.

* * * * *